US005706770A

United States Patent [19]

Schmidt et al.

[11] Patent Number: 5,706,770

[45] Date of Patent: Jan. 13, 1998

[54] VALVE DRIVE OF AN INTERNAL COMBUSTION ENGINE

[75] Inventors: Dieter Schmidt, Nuremberg; Arndt Ihlemann; Bodo Rorig, both of Herzogenaurach, all of Germany

[73] Assignee: INA Walzlager Schaeffler KG, Germany

[21] Appl. No.: 687,540

[22] PCT Filed: Mar. 11, 1995

[86] PCT No.: PCT/EP95/00908

§ 371 Date: Aug. 2, 1996

§ 102(e) Date: Aug. 2, 1996

[87] PCT Pub. No.: WO95/27842

PCT Pub. Date: Oct. 19, 1995

[30] Foreign Application Priority Data

Apr. 6, 1994 [DE] Germany ..... 94 05 694 U

[51] Int. Cl.[6] ..... F01L 1/18

[52] U.S. Cl. ..... 123/90.39; 123/90.36; 74/559

[58] Field of Search ..... 123/90.36, 90.39, 123/90.4, 90.41, 90.44, 90.45, 90.47; 74/519, 559

[56] References Cited

U.S. PATENT DOCUMENTS

| | | | |
|---|---|---|---|
| 1,469,155 | 9/1923 | Hedberg | 123/90.33 |
| 1,699,657 | 1/1929 | Fagan | 123/90.47 |
| 1,984,198 | 12/1934 | Notter | 123/90.47 |
| 2,433,138 | 12/1947 | Marcell et al. | 411/105 |
| 2,769,434 | 11/1956 | Witzky | 123/54.7 |
| 4,253,434 | 3/1981 | Takizawa et al. | 123/90.39 |
| 4,630,576 | 12/1986 | Raymond | 123/90.36 |
| 5,101,777 | 4/1992 | Onishi et al. | 123/90.23 |
| 5,186,128 | 2/1993 | Murata et al. | 123/90.39 |
| 5,394,842 | 3/1995 | Kobayashi | 123/90.36 |

FOREIGN PATENT DOCUMENTS

| | | | |
|---|---|---|---|
| 966826 | 10/1950 | France . | |
| 2216860 | 8/1974 | France . | |
| 2620142 | 11/1977 | Germany . | |
| 86512 | 5/1982 | Japan | 123/90.39 |

*Primary Examiner*—Weilun Lo

*Attorney, Agent, or Firm*—Bierman, Muserlian & Lucas

[57] ABSTRACT

A finger lever for a valve drive of an internal combustion engine which finger lever is contacted in a central region by a control cam and cooperates at one end with a gas exchange valve in the opening direction while being pivoted at another end by a bore on a shaft for pivoting relative to a cylinder head of an internal combustion engine by means projecting radially beyond a peripheral surface of a shaft in the region of a surrounding cam follower.

2 Claims, 5 Drawing Sheets

VALVE DRIVE OF AN INTERNAL COMBUSTION ENGINE

DESCRIPTION

The invention concerns valve drive of an internal combustion engine whose finger lever (2) or rocker arm (9) is pivoted by a bore (7) on a shaft (8) for pivoting relative to a cylinder head.

Such an arrangement is known, for example, from the textbook: Bosch: Kraftfahrtechnisches Taschenbuch, 20th Edition, VDI-Verlag (1987). FIG. 1 on page 318 of this book shows a rocker arm drive which is contacted indirectly at one end by a control cam acting through a tappet rod while being held in position centrally relative to a cylinder head by means of a pedestal and a shaft. A drawback of this type of device considered to be generic is that an axial positional fixing of the rocker arm on the shaft is effected as a rule by using spacing bushes or other stops between the lever concerned and the adjacent pedestal. It is also known in the art to support the rocker arm on the pedestal with the help of at least one compression spring. Such arrangements are not only relatively complicated from the manufacturing point of view but also cause additional frictional wear.

In case a finger lever is used as a cam follower in the drive, it is known in the art to provide fixing means at the valve-proximate end of the finger lever. Thus, for example, at its end facing the associated gas exchange valve, the finger lever can comprise cheeks which extend away from the cam and prevent a lateral excursion of the finger lever. A disadvantage of this arrangement is that the axial dimension of the cheeks required in valve direction reduces the available design space for at least one valve spring by which the gas exchange valve is loaded in closing direction. Another known solution is to arrange adjusting discs having a guiding profile for the finger lever on the spring retainer of the gas exchange valve. Due to these adjusting discs, additional forces come to act on the valve stem and lead to increased friction in the guideway of the valve stem and to premature wear.

The object of the invention is therefore to create an improved cam follower of the initially cited type in which the aforesaid disadvantages and drawbacks are eliminated and which, in particular, can be fixed in an exact position relative to its pivoting axis by simple means and at low manufacturing costs.

The invention achieves this object wherein a simple axial fixing of the finger lever or rocker arm, as the case may be, on its associated shaft is obtained. Additional friction-increasing stops for the shaft on the pedestal and other complicated measures such as, for example, shoulders on the shaft can thus be dispensed with. The configuration of the invention provides a pivoting of the cam follower with particularly low friction while, at the same time, simplifying assembly.

The solution of the invention is also applicable when using hydraulic or mechanical clearance compensation elements, not specified further here, which are integrated in both embodiments in the valve-proximate end of the cam follower.

Positional fixing is achieved by a circlip which is pretensioned in an outward or an inward direction. This circlip constitutes a particularly simple means for a positional fixing of the finger lever or rocker arm because it is available as a mass product and all that is still required is to provide the necessary grooves on the housing and the shaft.

However, it is also possible to make the recess of the bore of the finger lever or rocker arm in the form of a radial bore with a rolling element arranged therein which, to achieve fixing, extends at the same time beyond an annular surface situated between the two elements (cam follower and shaft). The use of a screw as a fixing means leads to the formation of an easily disengageable connection between the cam follower and the shaft. The invention equally covers fixing means other than the aforesaid rolling elements, for instance, cylindrical or pin-type fixing means and the like.

The region of the shaft surrounded by the bore of the finger lever or rocker arm comprises a radial bore in which, to achieve an axial fixing of the finger lever or rocker arm, extends at least one rolling element biased radially outwards by the force of at least one compression spring. This rolling element engages at the same time into an annular groove of the bore of the finger lever or rocker arm. For a radial positional fixing in outward direction, stops, not specified, can be provided for the rolling elements in the bore of the shaft.

A particularly advantageous variant of this fixing by rolling elements is wherein the radial bore is made as a through-bore at whose ends the rolling elements are arranged diametrically opposite each other. In this case, other coupling means similar to those described above are also conceivable.

A simple means of providing lubrication in all of the described embodiments is the use of at least one radial bore extending through the shaft to the bore of the housing. In this case, the shaft is configured as a hollow shaft.

According to a further feature of the invention, a separate bush is arranged in the radial bore of the shaft and has a length corresponding approximately to the length of the radial bore. This bush is a simple means for providing a guidance for the compression spring acting on the rolling elements.

Finally, a further advantageous embodiment of a positional fixing of a finger lever or rocker arm on an associated shaft. For assembly, the recess is advantageously aligned to a lateral end of a sector-shaped recess of the bore so that the rolling element can be inserted through the radial bore of the cam follower. During operation of the internal combustion engine it is guaranteed that the cam follower pivots in such a way that the rolling element cannot fall out of the bore. The sector-shaped recess serves at the same time to limit the pivoting motion of the cam follower on the shaft. The invention equally covers means other than the rolling elements described here for the positional fixing of the shaft. Such means could be, for example, a screw or pin connection and the like.

Alternative solutions for an axial positional fixing of the cam follower on its associated shaft comprise the shaft, or optionally, the housing surrounding it, comprises a sector-shaped recess. The lateral ends of the recess serve at the same time to define the maximum angle of pivot of the cam follower on the shaft. It is also conceivable to use fixing means which project from the shaft only on one side although fixing means projecting from the shaft on both sides are preferred.

The invention is not limited solely to the features contained in the claims. Rather, combinations of individual features of the claims with one another and with the disclosures contained in the discussion of the embodiments are both conceivable and intended.

Referring now to the drawings.

Figure 1:
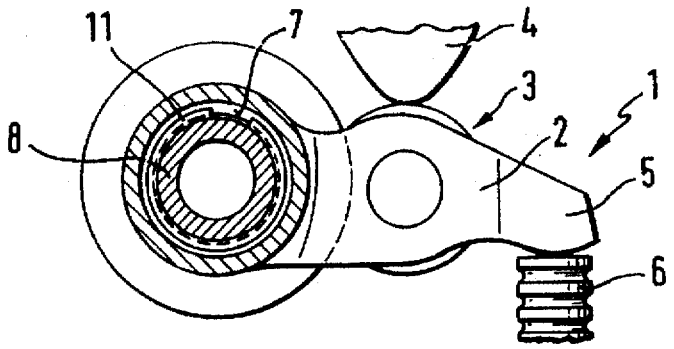
FIG. 1 is a side view of a valve drive of the invention.

FIG. 1 shows, in simplified form, a valve drive 1 comprising a finger lever 2 which is contacted in its central region 3 by a control cam 4. With its cam-distal end 5, the finger lever 2 acts in lifting direction on a gas exchange valve 6, not represented in detail. In the other end of the finger lever 2 there is arranged a bore 7 which extends parallel to the camshaft. With this bore 7, the finger lever 2 is mounted on a shaft 8 for pivotal motion relative to a cylinder head, not shown, of an internal combustion engine.

Figure 2:
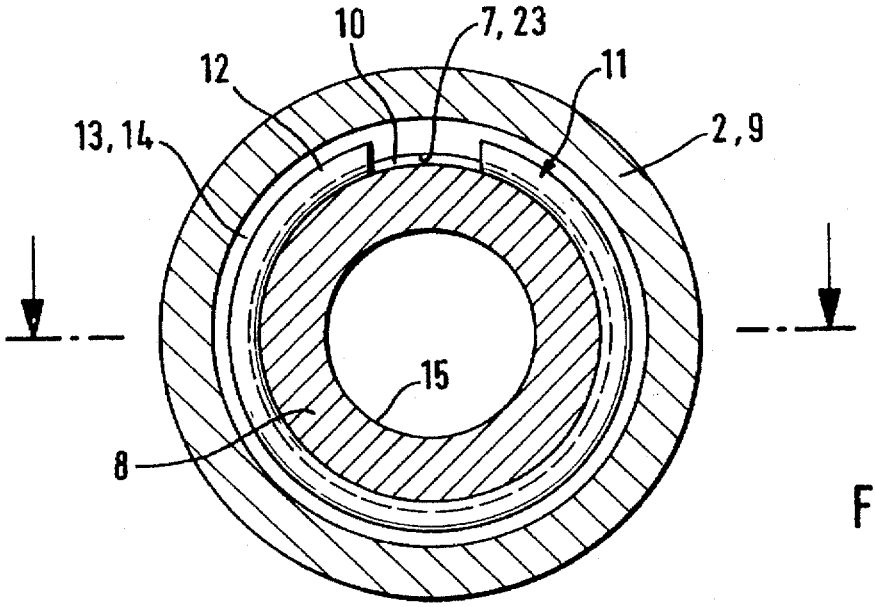
FIG. 2 is an enlargement from FIG. 1 showing an inwards biased circlip.
Figure 3:
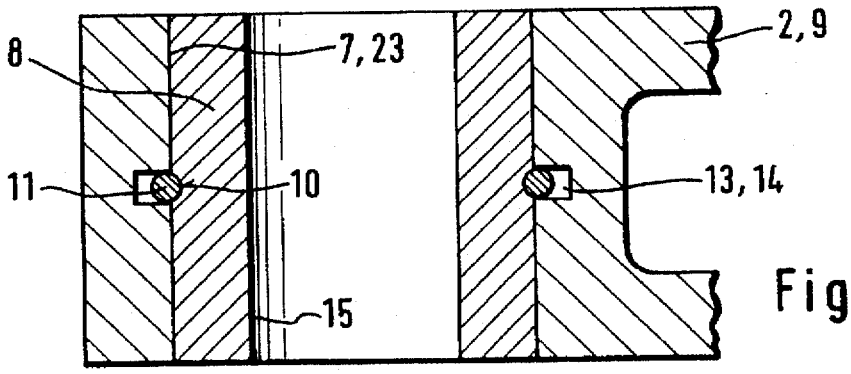
FIG. 3 is a cross-sectional view from FIG. 2.

FIG. 2 shows a means provided by the invention for a positional fixing of the finger lever 2 but which can likewise be used for fixing a rocker arm 9. A region of the shaft 8 which is surrounded by the bore 7 of the finger lever 2 or of the rocker arm 9 comprises an annular groove 10 in which extends an inwards biased circlip 11. An outer annular portion 12 of the circlip 11 extends at the same time in a recess 14 in the form of an annular groove 13 provided in the bore 7 of the finger lever 2 or the rocker arm 9. In this way, a simple positional fixing of the finger lever 2 or rocker arm 9 on its associated shaft 8 is achieved (see also FIG. 3). The shaft 8 in this embodiment is a hollow shaft which, on the one hand is advantageous as to its mass and on the other hand, its bore 15 can be used for the transfer of hydraulic medium for the lubrication of the mounting location in the bore 7 of the finger lever 2 or rocker arm 9.

Figure 4:
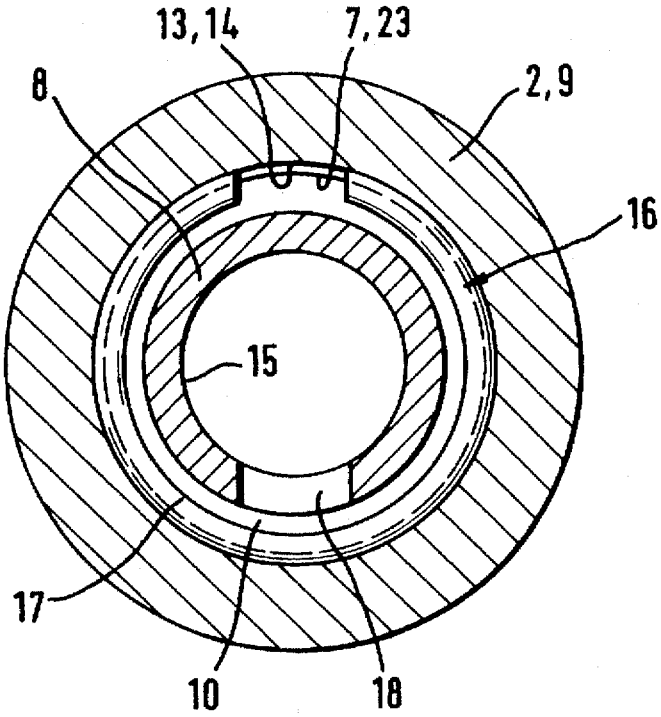
FIG. 4 is similar to FIG. 2 but shows an outwards biased circlip.

The embodiment of FIG. 4 for a positional fixing of the finger lever 2 or rocker arm 9 is similar to that of FIG. 2. However, in this case, the circlip 16 is biased radially outwards and thus extends in a recess 14 in the form of an annular groove 13 made in the finger lever 2 or rocker arm 9, and an inner annular portion 17 of the circlip 16 extends at the same time in the annular groove 10 of the shaft 8. As can likewise be seen in this figure, the shaft 8 can comprise in the region of the surrounding finger lever 2 or rocker arm 9, a radial bore 18 serving for the lubrication of the mounting location of the finger lever 2 or rocker arm 9 on the shaft 8, the lubricant being transferred through the bore 15 of the shaft 8.

Figure 5:
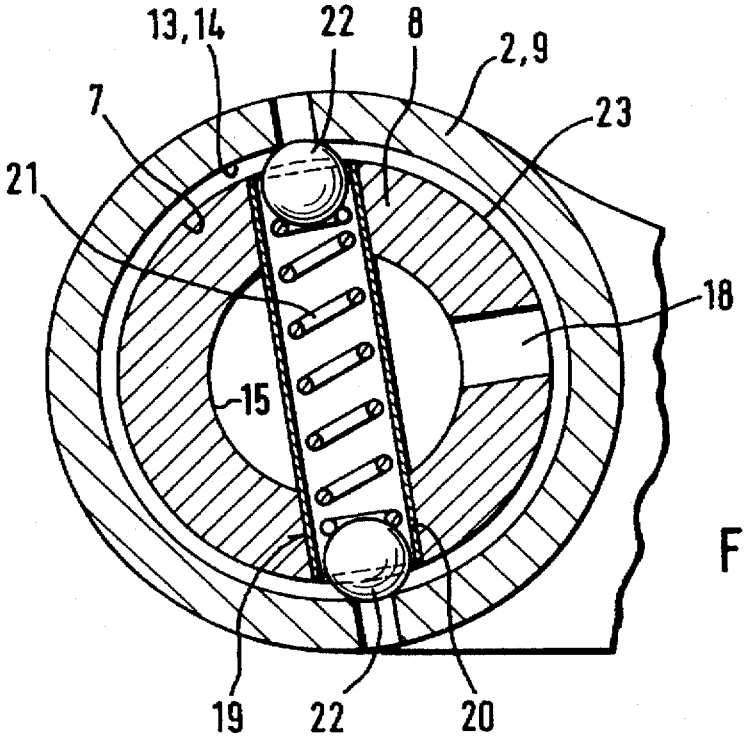
FIG. 5 shows an axial securing of a cam follower in the form of a finger lever or rocker arm by rolling elements arranged in a bore of the shaft.

An alternative embodiment for a positional fixing of the finger lever 2 or rocker arm 9 for pivoting motion on the shaft 8 can be seen in FIG. 5. In this case, in the region of the surrounding finger lever 2 or rocker arm 9, the shaft 8 comprises a through radial bore 19 piercing the shaft 8. A bush 20 having a length corresponding to the diameter of the shaft 8 is inserted into this radial bore 19. A compression spring 21 arranged in the bush 20 acts at each of its ends on a rolling element 22. The rolling elements 22 extend beyond a peripheral surface 23 of the shaft 8 so that a part of their outer periphery extends at the same time in the annular groove 13 of the bore 7 of the finger lever 2 or rocker arm 9. In this embodiment, the bush 20 serves on the one hand as a guide for the compression spring 21 and on the other hand, it prevents a transfer of lubricant from the bore 15 through the radial bore 19 into the bore 7. A transfer of lubricant at this location can be established by other means so that the radial bore 18 can then be omitted.

Figure 6:
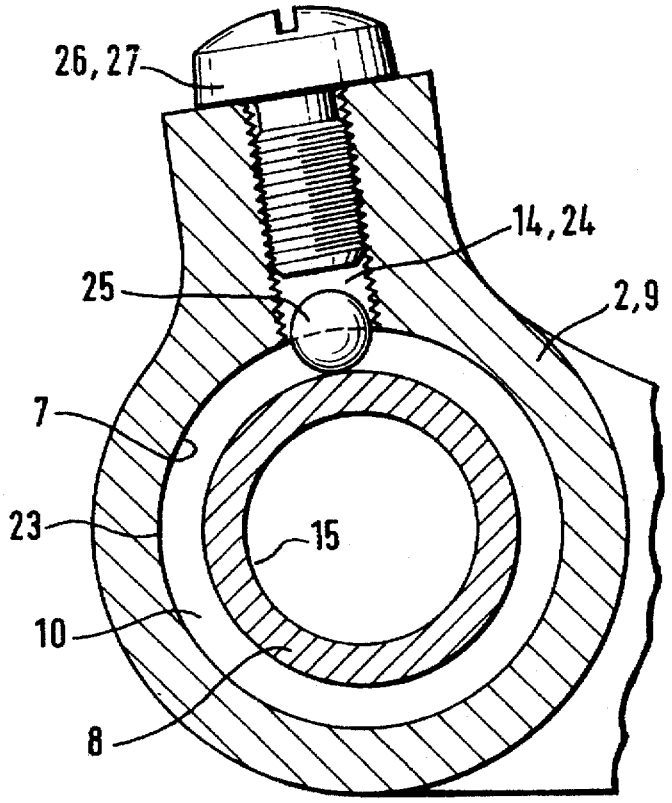
FIG. 6 shows an axial securing of the cam follower on the shaft by a rolling element arranged in the cam follower.
Figure 7:
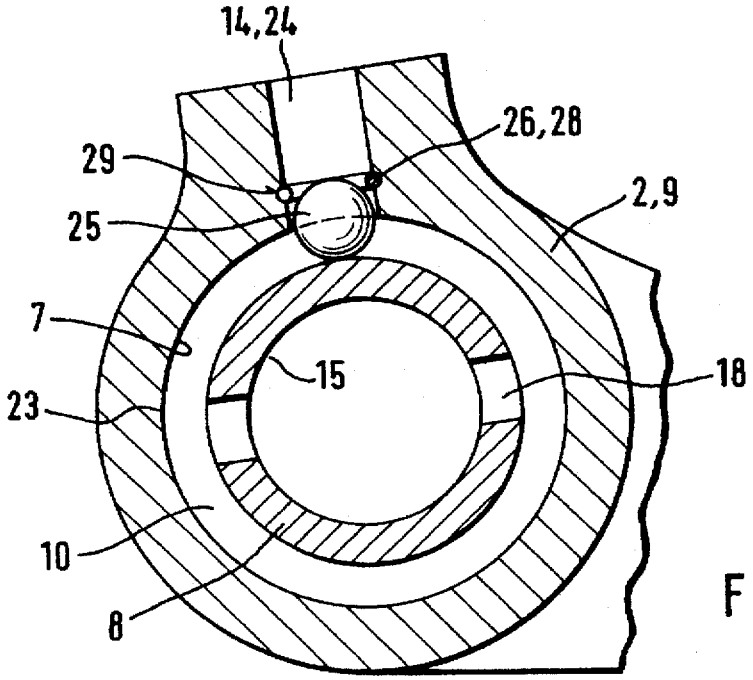
FIG. 7 shows an embodiment similar to that of FIG. 6.
Figure 8:
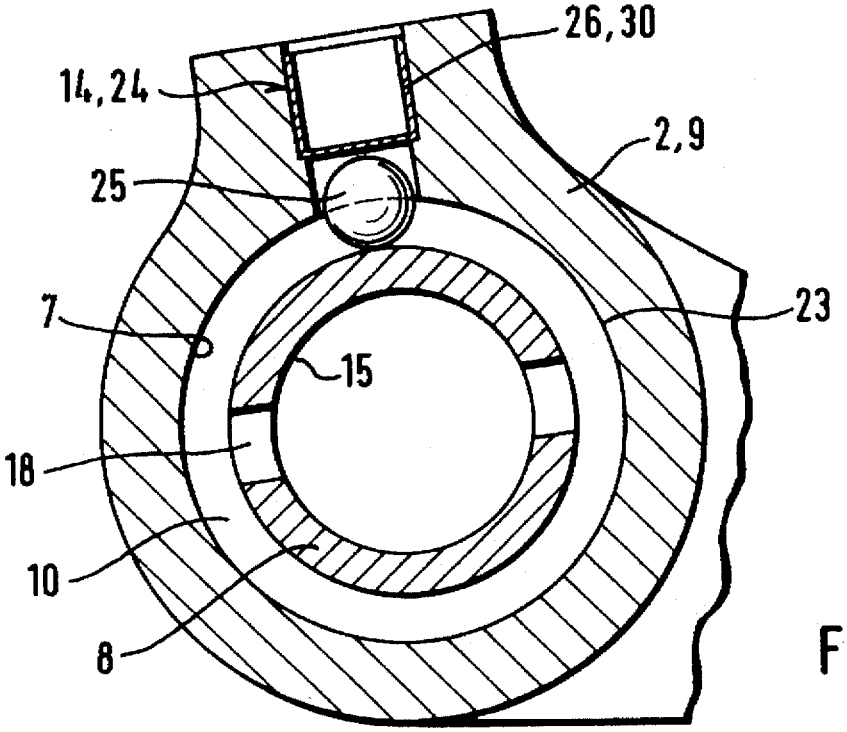
FIG. 8 shows a further embodiment similar to those of FIGS. 6 and 7.

Further alternative configurations for a positional fixing of a finger lever 2 or rocker arm 9 are shown in FIGS. 6 and 8. The recess 14 in the bore 7 of the finger lever 2 or rocker arm 9 is made in the form of a bore 24 extending radially of the longitudinal axis of the shaft 8. Positional fixing is achieved by a rolling element 25 arranged in a radially inner region of the bore 24. In the embodiments of FIGS. 6 to 8, this rolling element 25 extends at the same time into the annular groove 10 of the shaft 8. In a radially outward direction, the rolling element 25 is positioned by a stop 26. In FIG. 6, the stop 26 is in the form of a screw 27, in FIG. 7 it is constituted by a ring 28 which extends in an annular groove 29 in the bore 24 of the finger lever 2 or rocker arm 9, while in FIG. 8 it takes the form of a bush 30 inserted into the bore 24. In all the embodiments shown in FIGS. 5 to 8, the rolling element 22 or 25 serving as a fixing means can possess a geometry different from the one shown here.

Figure 9:
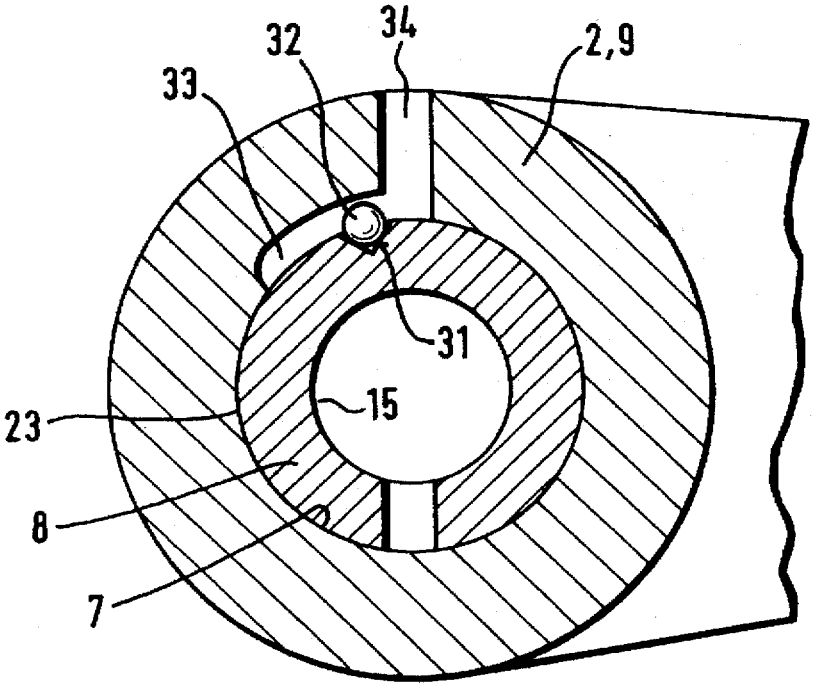
FIG. 9 shows an embodiment with a sector-shaped recess in the bore of the cam follower.

An alternative to the embodiments presented thus far for a positional fixing of the cam follower 2, 9 on an associated shaft 8 is shown in FIG. 9. In this case, the bore 7 of the cam follower 2, 9 comprises a sector-shaped recess 33 in which a part of a rolling element 32 extends which, at the same time, is arranged in a notch-shaped recess 31 of the shaft 8. A positioning of the finger lever or rocker arm 2, 9 on the shaft 8 is achieved in this case in a very simple manner. A radial bore 34 through the cam follower 2, 9 is made to align with the recess 31 so that the rolling element 32 can be introduced into the recess 31. Following this, during the mounting of a camshaft comprising a control cam, the cam follower 2, 9 is pivoted in valve direction such that the rolling element 32 cannot fall out of the radial bore 34 during the operation of the internal combustion engine. It is likewise conceivable to arrange the radial bore 34 at the other lateral end of the recess 33 situated in anti-clockwise direction in the figure.

Figure 10:
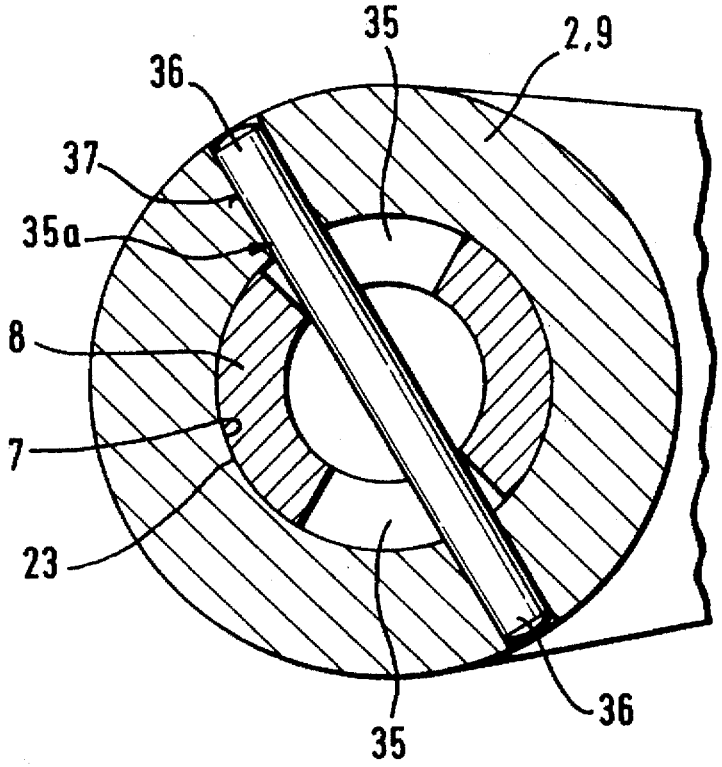
FIG. 10 shows an embodiment of a positional securing of the cam follower by a pin disposed in a sector-shaped recess of the shaft.
Figure 11:
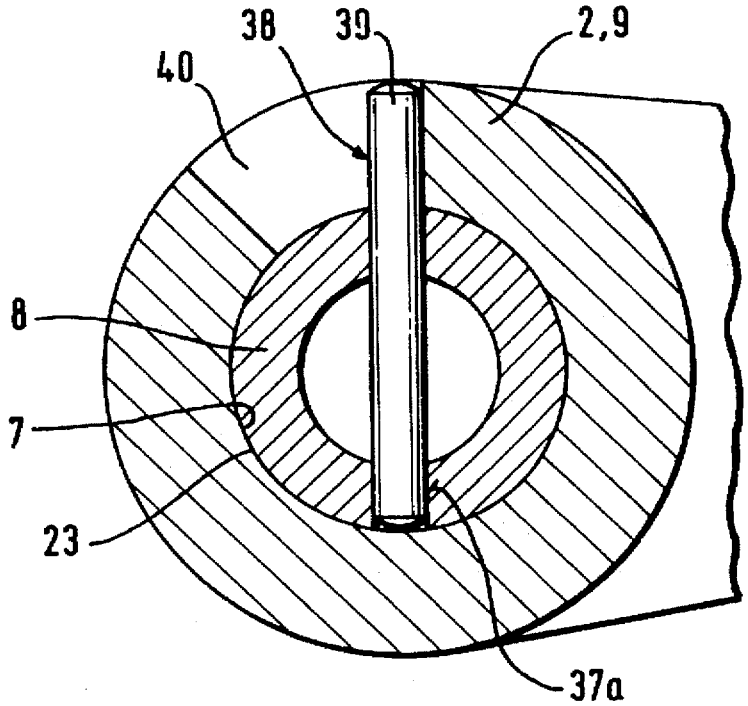
FIG. 11 shows an embodiment similar to that of FIG. 10 but with the sector-shaped recess arranged in the cam follower.

Finally, FIGS. 10 and 11 show still other embodiments of a positional fixing of the cam follower 2, 9 relative to the shaft 8. A pin 35*a* can be arranged in a sector-shaped recess 35 of the shaft 8 and extend with its ends 36 in a corresponding radial bore 37 of the cam follower 2, 9, or alternatively a pin 38 can be arranged in a radial bore 37*a* of the shaft 8 and extend at least with one end 39 in a sector-shaped recess 40 of the cam follower 2, 9. The lateral ends of the recesses 35 and 40 in each case constitute stops for the pins 35*a* and 38 respectively so that the maximum angle of pivot of the cam follower 2, 9 relative to the shaft 8 is defined.

It is both conceivable and intended to make the finger lever 2 or rocker arm 9 with its associated pivot shaft 8 out of a light-weight and/or a polymeric material. Thus, for instance, the finger lever 2 or rocker arm 9 may be made of an aluminium-based material but it is equally conceivable to make it out of sheet metal.

We claim:

1. A valve drive of an internal combustion engine whose finger lever (2) or rocker arm (8) is pivoted by a bore (7) on a shaft (8) for pivoting relative to a cylinder head, a region of the shaft (8) which is surrounded by the bore (7) of the finger lever (2) or rocker arm (9) and extends at least near a central longitudinal plane thereof comprises a recess (10, 19, 31, 35, 37*a*) in which a projecting means (11, 16, 22, 25, 32, 35*a*, 38) is arranged so as to extend radially beyond a peripheral surface (23) of the shaft (8) and engage into a recess (13, 14, 24, 33, 37, 40) of complementary shape made in the bore (7), or said projecting means is arranged in the recess of the bore (7) to project therefrom and into the recess of the shaft, characterized in that the recess of the shaft (8) is made of an annular groove (10) which is surrounded by the recess of the bore (7) made as an annular groove (13), the projecting means is optionally a radially inwards biased circlip (11) arranged in the annular groove (10) or a radially outwards biased circlip (16) arranged in the annular groove (13), an outer annular portion (12) of the circlip (11) extending into the annular groove (13) and an inner annular portion (17) of the circlip (16) extending into the annular groove (10).

2. A valve drive of claim 1 wherein the shaft (8) is made as a hollow shaft comprising a bore (15), and in the region of shaft (8) surrounded by the finger lever (2) or rocker arm (9), there is arranged at least one radial bore (18) for a transfer of lubricant to the bore (7).

* * * * *